United States Patent [19]

Bryerton

[11] 4,060,871

[45] Dec. 6, 1977

[54] WATER-POWERED DISH SCRUBBER

[75] Inventor: John B. Bryerton, Lock Haven, Pa.

[73] Assignee: Raymond Lee Organization Inc., a part interest

[21] Appl. No.: 722,278

[22] Filed: Sept. 10, 1976

[51] Int. Cl.[2] ..... A46B 13/06
[52] U.S. Cl. ..... 15/29
[58] Field of Search ..... 15/24, 29, 97 R, 93 R, 15/101, 23, 28

[56] References Cited

U.S. PATENT DOCUMENTS

| | | | |
|---|---|---|---|
| 1,228,897 | 6/1917 | Frame | 15/24 X |
| 1,694,733 | 12/1928 | Cummins | 15/29 |
| 2,719,994 | 10/1955 | Dorsey | 15/24 |

*Primary Examiner*—Edward L. Roberts

[57] ABSTRACT

A housing has a pistol type grip with a trigger-operated valve located inside it. The housing is attached to one end of a flexible hollow hose that is detachably secured to a water fawcet. A shaft, rotatably secured in the housing, is caused to rotate by water pressure when the valve is opened. Various kinds of scrubbing devices can be detachably secured to the shaft, for use in scrubbing dishes.

3 Claims, 9 Drawing Figures

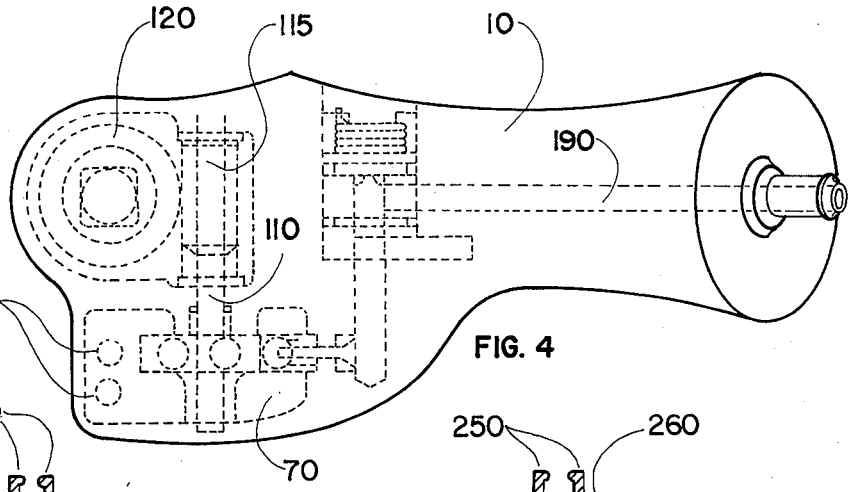
FIG. 4
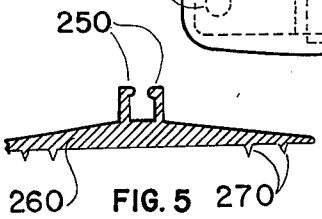
FIG. 5
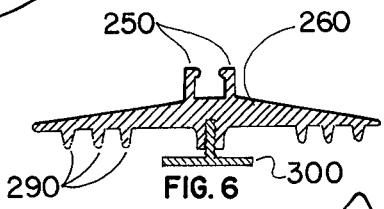
FIG. 6
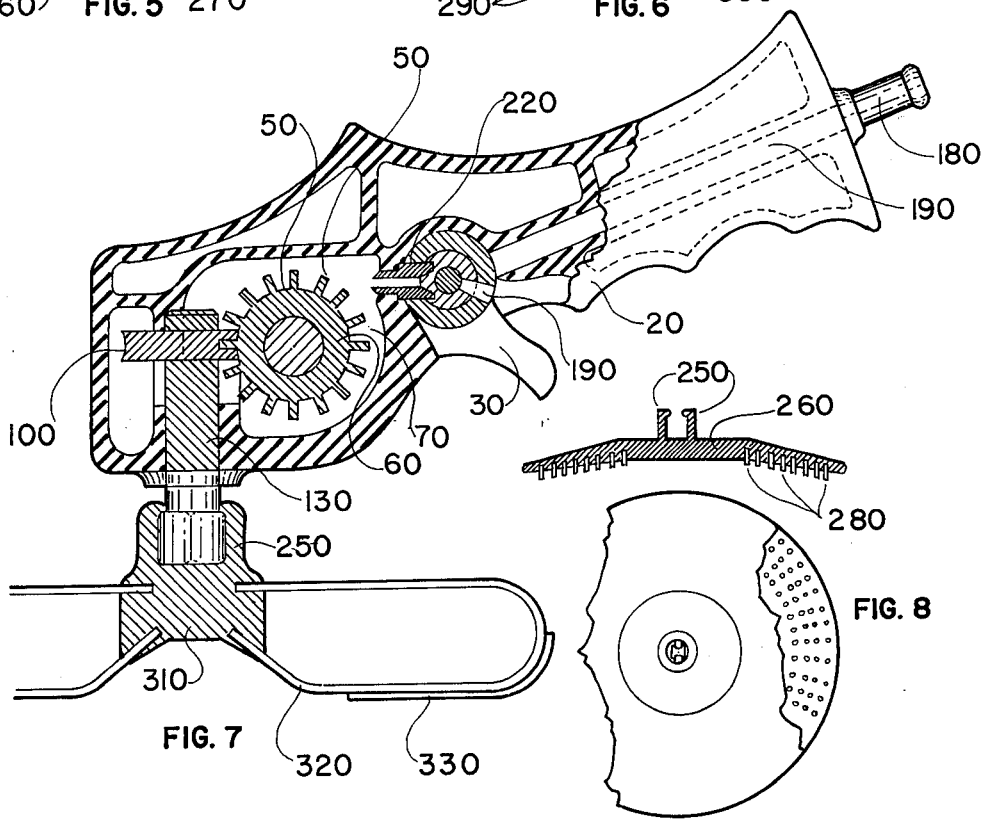
FIG. 7
FIG. 8

WATER-POWERED DISH SCRUBBER

SUMMARY OF THE INVENTION

This invention provides a device that will aid in the scrubbing and washing of dishes. The device causes any one of a collection of brushes to rotate under the influence of water pressure, clearing debris and the like off the dishes to be washed, and eliminating possible hazards associated with the use of electric motors in a wet working environment.

This invention utilizes a housing with a pistol type grip and a trigger-operated valve. The housing is attached to one end of a flexible hose that is detachably secured at its remote end to a faucet in a kitchen sink or the like. A shaft extends downwardly out of the housing, and is caused to rotate about its axis by water pressure when the valve is opened. To the shaft may be detachably secured any one of a plurality of brushes that will aid in the cleaning of dishes.

BRIEF DESCRIPTION OF THE DRAWINGS

FIG. 4 shows the housing of the invention as viewed from the top.

FIGS. 5 and 6 show two types of attachments for use with the invention.

FIG. 7 shows a side cross-sectional view of the invention.

FIG. 8 shows a third type of attachment for use with the invention.

DETAILED DESCRIPTION OF PREFERRED EMBODIMENTS

Figure 1:
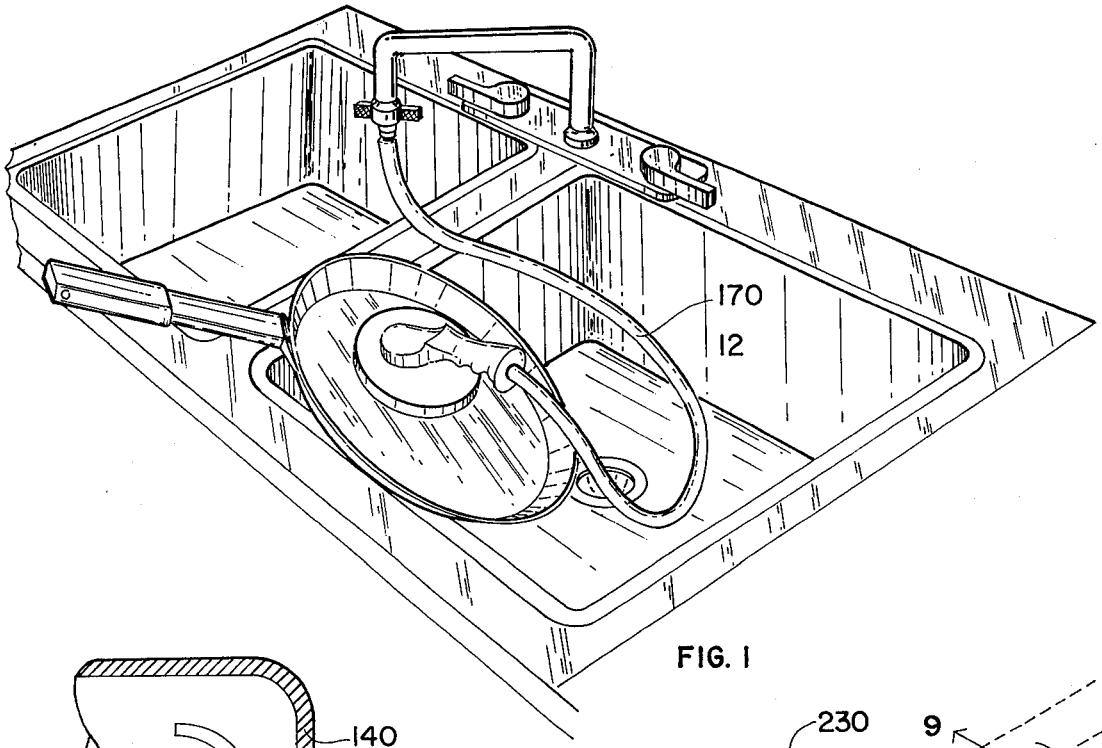
FIG. 1 shows the invention in use.

A housing 10 has a pistol-grip type handle 20 with a trigger 30 that operates a valve. Disregarding for the moment the operation of the valve, it can be seen that a jet of water 40 inside the housing will, when directed upon the blades 50 of paddlewheel 60, rotate the paddlewheel which is also located in the housing, being located in cavity 70. The paddle wheel rotates in a vertical plane and rotates horizontal shaft 80 with it in cavity 110. At the end of shaft 80 is a worm gear 90 in cavity 115 which rotates horizontal gear 100 that is also located in the housing, in cavity 120. Finally, gear 100 rotates vertically elongated shaft 130 about its axis. It is important to realize that what has just been described is merely a paddlewheel - powered transmission which converts the kinetic energy of the water jet to rotation of shaft 130.

The jet of water is developed from water pressure at faucet 140. Stopper 150 is inserted into the open end of the faucet, and the open upper end of hollow tube 160 located in the stopper is thus positioned to receive water coming out of the faucet. The lower end of tube 160 is attached to one end of flexible hollow hose 170. It may thus be seen that the hose is detachably secured to the faucet.

The remote end of the hose is clamped to pipe 180 located at the rear of the housing and communicating with bore 190 in it. The bore runs forwardly and downwardly to a part of the trigger valve assembly. This latter assembly has four main parts— a valve body 200, the trigger 30, hollow tube 210 and nozzle 220. Valve body 200 has an opening 205 which is not aligned with bore 190 when the valve is closed. This opening communicates with the interior of tube 210, as does nozzle 220. The ends of tube 210 are closed. It can thus be seen that when water under pressure is allowed to enter opening 205, the water will be ejected through the nozzle. Normally, torsion spring 230 (which is located between body 200 and the housing) keeps the tube biased so that the trigger is rotated to its forwardmost position. In this position, valve body 200 closes off bore 190. However, when the trigger is pulled, the tube rotates, causing the opening to become aligned with the bore and causing the jet to be directed towards the paddlewheel. Water then is forced through the jet, rotating the paddlewheel and shaft 130, as described above. The water thus sprayed into cavity 70 drains downwardly out of the cavity through holes 240 in the housing.

The bottom end of shaft 130 is cubical in shape. Any one of a number of attachments may be detachably secured to the bottom end of the shaft. Each of the attachments has two opposed, flexible lips 250 that fit over opposite corners of this bottom end. As for the attachments shown in FIGS. 5, 6 and 8, the lips are integrally formed with disc 260. In FIG. 5, nubs 270 on the bottom of the disc are little teeth used for scouring. In FIG. 8, 280 denotes brush bristles located on the lower surface of the disc. In FIG. 6, a disc of steel wool or the like can be pressed against teeth 290 in the bottom of the disc, and thereby kept from rotating, by the pressure of flat, wide knob 300, which can be threaded into the center of the disc after being passed through the steel wool. In FIG. 7, the stud 310 with which lips 250 are integrally molded supports a toroidal, generally doughnut shaped flange 320. On the lower surface of this flange is abrasive scrubbing material 330.

Figure 2:
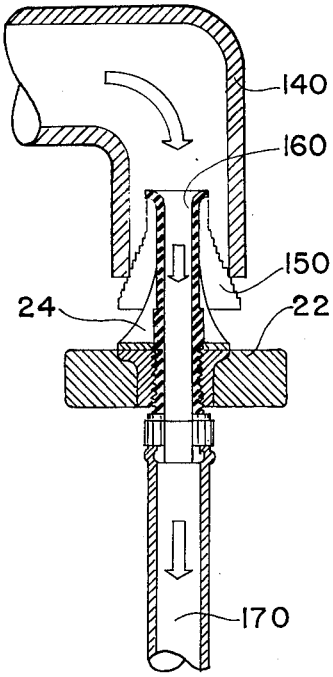
FIG. 2 shows how the invention is connected to a source of water under pressure.

With reference to FIG. 2, it will be seen that by rotating blade 22 on tube 160, wedge 24 is forced into stopper 150, causing it to expand whereby it is attached firmly to the water supply.

Figure 3:
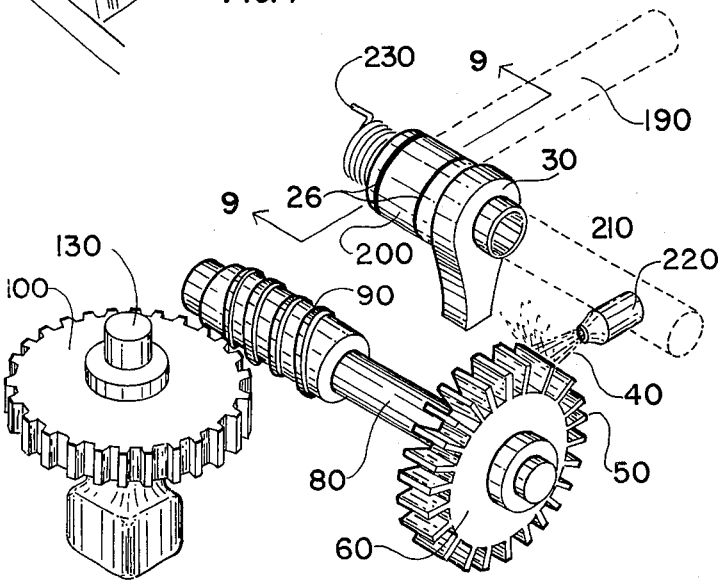
FIG. 3 is a schematic showing of some of the mechanism of the invention.
Figure 9:
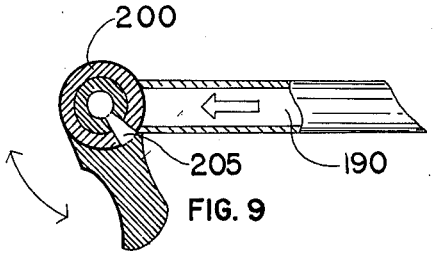
FIG. 9 shows how the trigger-operated valve operates.

With reference to FIG. 3, it will be seen that two ring seals 26 are incorporated into body 200 to prevent water seepage when trigger 30 is forward (off).

I claim:

1. A water powered scrubber for use in dishwashing operations and connectable to a source of water under pressure, said scrubber comprising:

a hollow housing having drain holes in the bottom thereof;

a hollow flexible hose attached at one end to the housing and detachably secured at the other end to said source;

trigger operated valve means located in the housing and connected in series with the hose, said means including a nozzle, said means when the trigger is pulled allowing water to flow through the hose into the nozzle, said water being expelled from the nozzle as a jet, said means when the trigger is not pulled blocking the flow of water;

a first vertical shaft having an upper end in the housing and a lower end projecting downwardly out of the housing; said lower end being cubically shaped;

a brush like attachment disposed outside of the housing below the first shaft, said attachment having two opposed flexible lips detachably engaging the cubically shaped lower end of the first shaft;

a horizontal gear in the housing secured to the upper end of the first shaft;

a vertical paddle wheel in the housing disposed in the path of the jet, said jet impinging upon the wheel to cause same to rotate about its center in a vertical plane, the water thereafter draining downward through said holes;

a second horizontal shaft in the housing disposed at right angles to the wheel, said wheel being secured at its center to one end of the second shaft; and a horizontal worm at the other end of the second shaft and engaging said gear whereby rotation of the wheel causes rotation of the second shaft, worm, gear, first shaft and attachment.

2. The scrubber of claim 1 further including additional attachments, each attachment having two opposed flexible lips for detachably engaging the cubical lower end of the first shaft.

3. The scrubber of claim 1 wherein the means includes a torsion spring and a hollow tube, said spring when the trigger is not pulled biasing the tube in a position that blocks water flow.

* * * * *